US006526943B2

(12) United States Patent
Augustin

(10) Patent No.: US 6,526,943 B2
(45) Date of Patent: Mar. 4, 2003

(54) CONTROL VALVE FOR HYDRAULICALLY OIL ACTIVATED FUEL INJECTOR

(75) Inventor: Ulrich Augustin, Blythewood, SC (US)

(73) Assignee: Siemens Diesel Systems Technology, LLC, Blythewood, SC (US)

( * ) Notice: Subject to any disclaimer, the term of this patent is extended or adjusted under 35 U.S.C. 154(b) by 0 days.

(21) Appl. No.: 09/983,037

(22) Filed: Oct. 22, 2001

(65) Prior Publication Data

US 2002/0092501 A1 Jul. 18, 2002

Related U.S. Application Data

(60) Provisional application No. 60/261,813, filed on Jan. 17, 2001.

(51) Int. Cl.[7] ..... F02M 37/04
(52) U.S. Cl. ..... 123/446; 239/92
(58) Field of Search ..... 123/446; 239/92, 239/585.1

(56) References Cited

U.S. PATENT DOCUMENTS 4,182,492 A * 1/1980 Albert et al. ..... 239/92
5,479,901 A * 1/1996 Gibson et al. ..... 123/472
5,597,118 A * 1/1997 Carter, Jr. et al. ..... 239/92
5,669,355 A 9/1997 Gibson et al.
5,738,075 A 4/1998 Chen et al.
5,954,030 A 9/1999 Sturman et al.
6,065,450 A 5/2000 Chen et al.
6,082,332 A 7/2000 Hefler et al.
6,119,960 A * 9/2000 Graves ..... 239/92
6,129,072 A 10/2000 Graves

* cited by examiner

*Primary Examiner*—Thomas N. Moulis
(74) *Attorney, Agent, or Firm*—McGuireWoods LLP

(57) ABSTRACT

An oil activated fuel injector which includes a control valve having a groove which provides a fluid path between a bore and a cross bore of the valve body. The fluid path leads to ambient such that a pressure within a pressure chamber is less than that of the rail pressure. This equalized pressure allows the spool within the valve body to move to a first position thus forming a fluid path between an inlet port and the working port leading to the intensifier chamber. When the fluid path is blocked, via movement of the groove out of alignment with the cross bar, the pressure within the pressure chamber increases thereby forcing the spool to move towards a second position. In the second position, a space is formed between the spool and the body of the injector to provide venting of the working fluid from the intensifier chamber to ambient.

14 Claims, 6 Drawing Sheets

CONTROL VALVE FOR HYDRAULICALLY OIL ACTIVATED FUEL INJECTOR

CROSS REFERENCE TO RELATED APPLICATION

This application claims priority to U.S. provisional application serial No. 60/261,813, filed on Jan. 17, 2001.

BACKGROUND OF THE INVENTION

1. Field of the Invention

The present invention generally relates to an oil activated fuel injector and, more particularly, to a control valve used with an oil activated electronically or mechanically controlled fuel injector.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

In current designs, a driver will deliver a current or voltage to an open side of an open coil solenoid. The magnetic force generated in the open coil solenoid will shift a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

However, in such a conventional system, a response time between the injection cycles may be slow thus decreasing the efficiency of the fuel injector. This is mainly due to the slow movement of the control valve spool. More specifically, the slow movement of the control valve may result in a slow activation response time to begin the injection cycle. To remedy this inadequacy, additional pressurized working fluid may be needed; however, additional energy from the high pressure oil pump must be expanded in order to provide this additional working fluid. This leads to an inefficiency in the operations of the fuel injector, itself. Also, the working fluid at an end of an injection cycle may not be vented at an adequate response rate due to the slow movement of the control valve spool.

The present invention is directed to overcoming one or more of the problems as set forth above.

SUMMARY OF THE INVENTION

In a first aspect of the present invention, a control valve for a fuel injector is provided. The control valve has a valve body and a spool positioned within a bore of the valve body and slidable between a first position and a second position. A first bore is in fluid communication with a rail inlet of the fuel injector and a cross bore is positioned within the valve body and offset from the first bore. A groove is located about the spool and provides fluid communication between the cross bore and the first bore when the spool is in the first position and seals fluid communication between the first bore and the cross bore when the spool is in the second position.

In another aspect of the present invention, a fuel injector includes a fuel injector body having a bore disposed therein and an inlet port positioned within the fuel injector body. A working port provides fluid communication to an intensifier chamber of the fuel injector. A first spool is positioned within the bore of the fuel injector body and is slidable between a first position and a second position. The first spool includes a first leading edge and a second leading edge. A space is formed between the first leading edge and the fuel injector body when the first spool in the second position. A pressure chamber is associated with the first spool. A control valve is in communication with the pressure chamber and includes a valve body and a control spool positioned within a bore of the valve body and slidable between a first position and a second position. A first bore is in fluid communication with the pressure chamber and a cross bore is in fluid communication with ambient and positioned within the valve body and offset from the first bore. A groove is positioned about the control spool. In the first position of the control spool, the groove provides fluid communication between the cross bore and the first bore such that a pressure within the pressure chamber is substantially equal to a rail inlet pressure thereby permitting the first spool to move in the direction of the first position. This seals the space between the first leading edge and the fuel injector body and allows working fluid to flow from the inlet port to the intensifier chamber. In the second position of the control spool, the groove moves out of alignment with the cross bore thus inhibiting fluid flow between the pressure chamber and ambient such that the pressure within the pressure chamber increases to a higher pressure than the rail inlet pressure. This forces the first spool in the direction of the second position to form the space between the first leading edge and the fuel injector body and allowing working fluid to vent to ambient from the intensifier chamber.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to an oil activated electronically, mechanically or hydraulically controlled fuel injector and more particularly to a control valve used with an oil activated fuel injector. The control valve of the present invention is capable of providing a short control valve stroke which, in turn, translates into a fast response time for the outflow of the inlet rail pressure. The oil activated fuel injector of the present invention will thus increase efficiency of the injection cycle.

Embodiments of the Oil Activated Fuel Injector of the Present Invention

Figure 1:
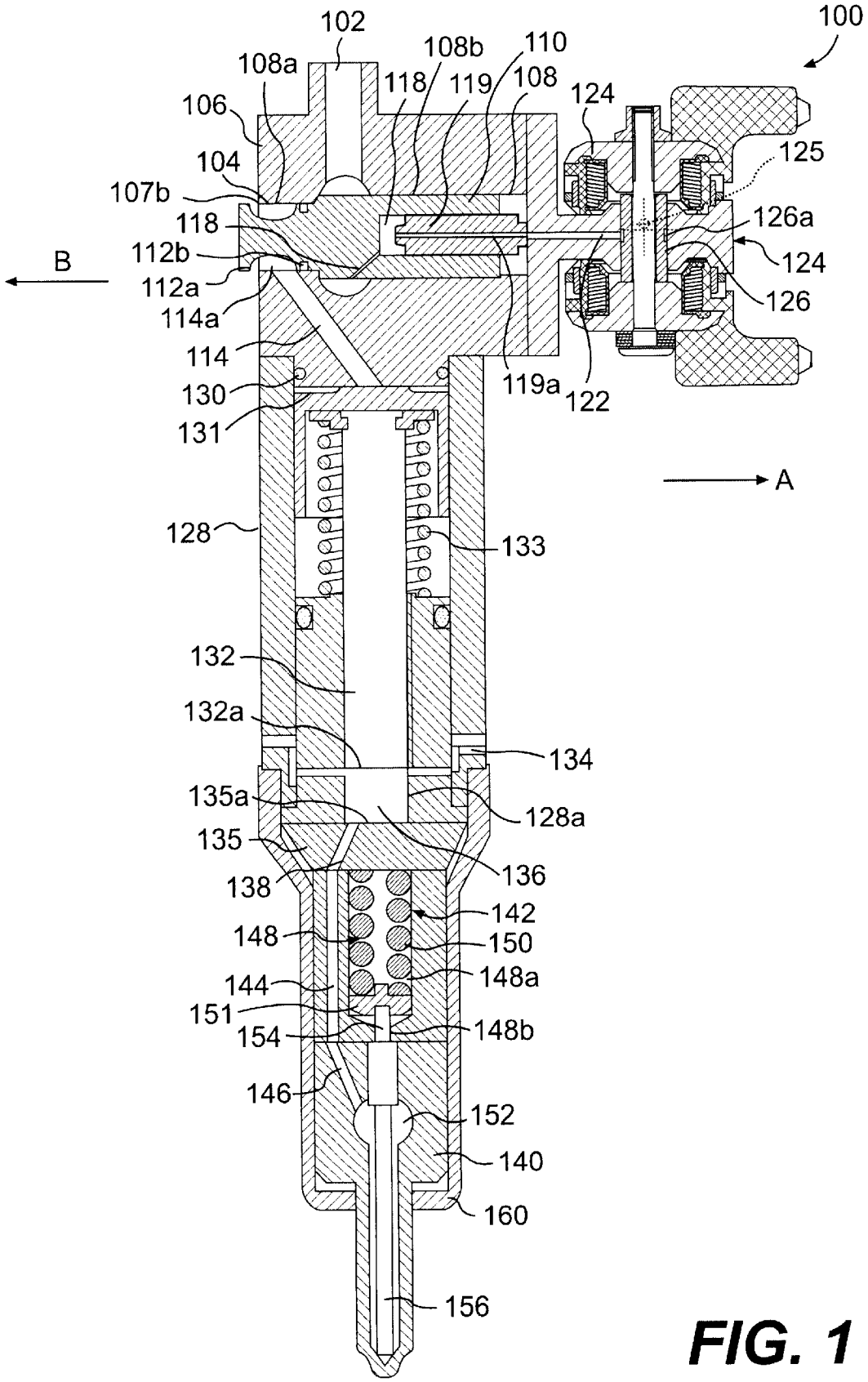
FIG. 1 shows an oil activated fuel injector used with a control valve of the present invention.

Referring now to FIG. 1, the fuel injector is generally depicted as reference numeral 100 and includes an inlet area 102 which receives working fluid such as, for example, engine lubricant, from an inlet rail (not shown). The fuel injector 100 also includes a body 104 having a flat body area 106 and a central bore 108. The central bore 108 includes a first diameter 108*a* and a second diameter 108*b* where, in embodiments, the first diameter 108*a* is slightly smaller than the second diameter 108*b*. A spool 110 is slidably positioned within the central bore 108 and includes a groove 112 positioned within the first diameter 108*a*. The groove 112 includes a first leading edge 112*a* and a second leading edge 112*b* and provides fluid communication between the inlet port 102 and the bore or working port 114 (which leads to the intensifier chamber). A venting space 107 is developed between the first leading edge 112*a* and the flat body area 106 in the position of the spool 110 of FIG. 1. It should be recognized by those of ordinary skill in the art that the venting space 107 is sealed when the spool is moved in the direction of arrow "B". As discussed in more detail below, the working fluid in the intensifier chamber is allowed to vent via the space 107 at the termination of the injection cycle.

The spool 110 further includes a throttle 116 which provides fluid communication between the inlet port 102 and a pressure chamber 118. The pressure chamber 118 is defined by a partial bore 118*a* within the spool 110 and a servo piston 119. The servo piston 119 is partly located within the partial bore 118*a* and further includes a central bore 119*a*. The central bore 119*a* is in fluid communication with the pressure chamber 118 which provides, in part, a mechanism for the working fluid to be vented to ambient during an initial stage of the injection cycle.

Still referring to FIG. 1, the control valve includes a spool body 124 having a bore 122 which is in axial alignment with the central bore 119*a* of the servo piston 119. The spool body 124 also includes a cross bore 125 which leads to ambient. A spool 126, slidably positioned within the spool body 124, includes a groove 126*a* which, in a first or activated position of the spool 110, overlaps with the bore 122 and the cross bore 125 to provide fluid communication therebetween. In turn, this position of the groove 126*a* (i.e., when the spool 126 is activated) provides a flow path for the working fluid from the inlet port 102 to ambient via (i) the inlet port 102, (ii) the throttle 116 (iii) the pressure chamber 118, (iv) the central bore 119*a*, (v) the bore 122, (vi) the groove 126*a* (vii) the cross bore 125, and (viii) ambient. At this pressure stage, the pressure within the pressure chamber 118 will be substantially equal to that of the inlet rail pressure.

In more particularity, in a first or activated position of the spool 126, the groove 126*a* overlaps both the bore 122 and the cross bore 125. In this position, the pressure within the pressure chamber 118 will equalize to that of the inlet rail pressure which, in turn, allows the slidable spool 110 to move in the direction of arrow "A". At this spool 110 position, the first leading edge 112*a* is positioned within the inside edge of the flat body area 106 (i.e., within the central bore 108) thus sealing the venting space 107. This allows working fluid to flow from the inlet port 102 through the bore 114 and into the intensifier body in order to begin an injection cycle. In a second or deactivated position of the spool 126, the groove 126*a* no longer overlaps with the bore 122 and the cross bore 125 (and hence will not lead the working fluid to ambient). In this spool 110 position, the working fluid will flow from the inlet port 102 to the pressure chamber 118, via the throttle 112*b*. This will increase the pressure within the pressure chamber 118 to a higher pressure than that of the inlet rail pressure. In turn, this increased or higher pressure will force the slidable spool 110 to move in the direction of arrow "B" (to a second position) thus moving the first leading edge 112*a* beyond the outside edge of the flat body area 106 and hence forming the venting space 107. Now, the working fluid within the intensifier chamber will be vented to ambient via the venting space 107 (FIG. 1) thus ending the injection cycle.

FIG. 1 further shows the remaining portions of the fuel injector used with the control valve of the present invention. It should be understood by those of ordinary skill in the art that the control valve of the present invention may equally be used with other fuel injector configurations. By way of example, these other fuel injector configurations may include a ball valve mechanism at the fuel inlet, or may equally include other angled or straight bores leading to the nozzle of the injector.

The intensifier body 128 is mounted to the body 104 via any conventional mounting mechanism. A seal 130 (e.g., o-ring) may be positioned between the mounting surfaces of the intensifier body 128 and the body 104. A piston 131 is slidably positioned within the intensifier body 128 and is in contact with an upper end of a plunger 132. An intensifier spring 133 surrounds a portion (e.g., shaft) of the plunger 132 and is further positioned between the piston 131 and a flange or shoulder formed on an interior portion of the intensifier body 128. The intensifier spring 133 urges the piston 131 and the plunger 132 in a first position proximate to the body 104.

As further seen in FIG. 1, a fuel inlet 134 is formed within the intensifier body 128, proximate an end portion 132*a* of the plunger 132. The fuel inlet 134 provides fluid communication between a high pressure chamber 136 and a fuel area (not shown). This fluid communication allows fuel to flow into the high pressure chamber 136 from the fuel area during an up-stroke of the plunger 132. A check disk 135 is positioned below the intensifier body 128 remote from the valve control body 102. The combination of an upper surface 135*a* of the check disk 135, an end portion 132*a* of the plunger 132 and an interior wall 128*a* of the intensifier body 128 forms the high pressure chamber 136. The check disk 135 also includes a fuel bore 138 in fluid communication with the high pressure chamber 136.

FIG. 1 further shows a nozzle 140 and a spring cage 142. The spring cage 142 is positioned between the nozzle 140 and the check disk 135, and includes a fuel bore 144 in fluid communication with the fuel bore 139 of the check disk 135. The spring cage 142 also includes a centrally located bore 148 having a first bore diameter 148*a* and a second smaller bore diameter 148*b*. A spring 150 and a spring seat 152 are positioned within the first bore diameter 148*a* of the spring cage 142, and a pin 154 is positioned within the second, smaller, bore diameter 148*b*. The nozzle 140, on the other hand, includes an angled bore 146 in alignment with the bore 144 of the spring cage 142. A needle 156 is preferably centrally located with the nozzle 140 and is urged downwards by the spring 150 (via the pin 154). A fuel heart chamber 152 surrounds the needle 156 and is in fluid communication with the bore 146. In embodiments, a nut 160 is threaded about the intensifier body 128, the check disk 135, the nozzle 140 and the spring cage 142.

Figure 2:
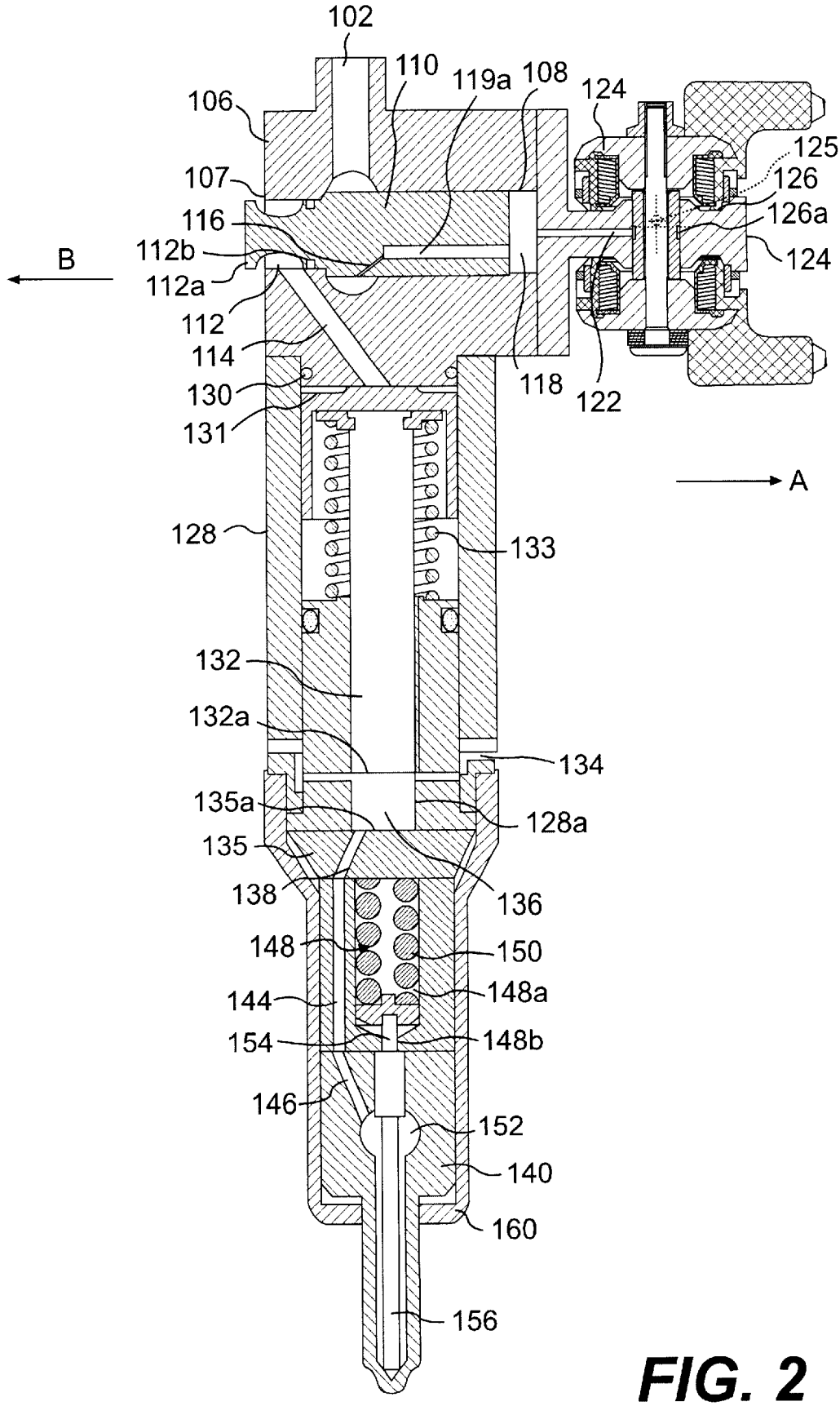
FIG. 2 shows an embodiment of the present invention.

FIG. 2 shows an embodiment of the present invention. In this embodiment, the high pressure chamber 118 is positioned between the end of the spool 110 and the valve body 124. That is, a portion of the central bore 108 forms the high pressure chamber 118 (between the spool 110 and the valve body 124). The bore 119*a* is located within the spool 118 and provides fluid communication between the high pressure chamber 118 and the throttle 116. The embodiment of FIG. 2 further shows the high pressure chamber 118 in fluid communication with the bore 122, with all of the remaining features and advantages substantially the same as the embodiment of FIG. 1.

As to the advantages and remaining features, it is noted by way of example that in a first or activated position of the spool 126, the slidable spool 110 will move in the direction of arrow "A" such that the first leading edge 112*a* is positioned within the inside edge of the flat body area 106. As previously discussed, this allows working fluid to flow into the intensifier body in order to begin an injection cycle. In a second or deactivated position of the spool 126, working fluid will flow into the pressure chamber 118 thus increasing the pressure therein to a higher pressure than that of the inlet rail pressure. This is due to the fact that the groove 126*a* is no longer overlapping with the bore 122 and the cross bore 125 (and hence will not lead to ambient). In turn, this higher pressure will force the slidable spool 110 to move in the direction of arrow "B" thus allowing the working fluid to vent from the intensifier chamber to ambient via the space 107 provided between the flat body 106 and the first leading edge 112*a*.

Figure 3:
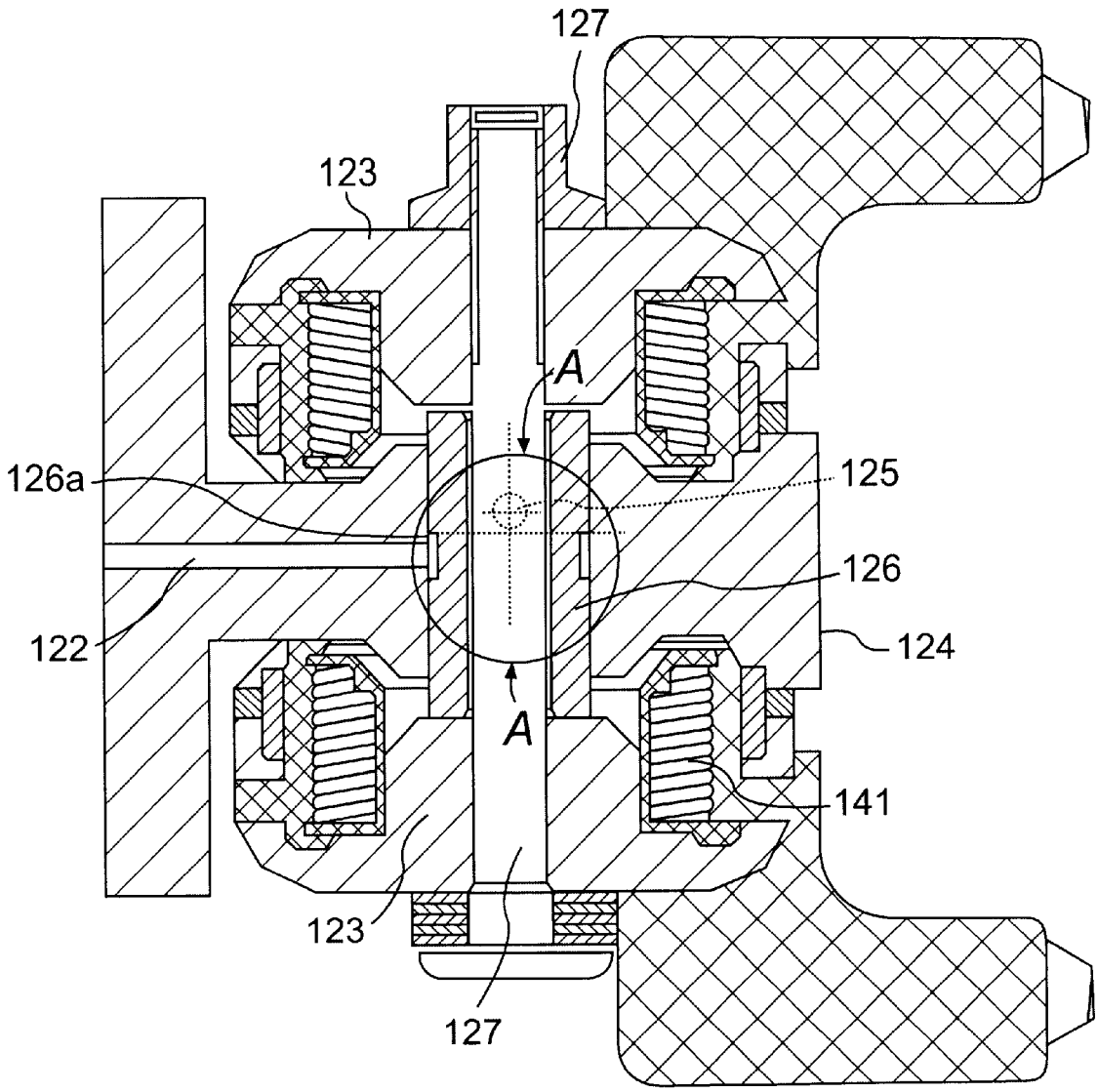
FIG. 3 shows an exploded view of the control valve of the present invention.

FIG. 3 is an exploded view of the control valve of the present invention. In this view, it is readily seen that the control valve of the present invention includes the valve body 124 having the bore 122 and the cross bore 125. Also, the spool 126 is slidably positioned within the spool body 124 and includes a groove 126*a* which provides fluid communication between the bore 122 and the cross bore 125 (when the spool is in the first position). The control valve body also includes end caps 123 which are mounted to the control valve body 124 via a nut and bolt mechanism 127 (or other mounting means). A coil 141 is used to activate and deactivate the spool 126 between the first or open position and a second or closed position, respectively.

Figure 4:
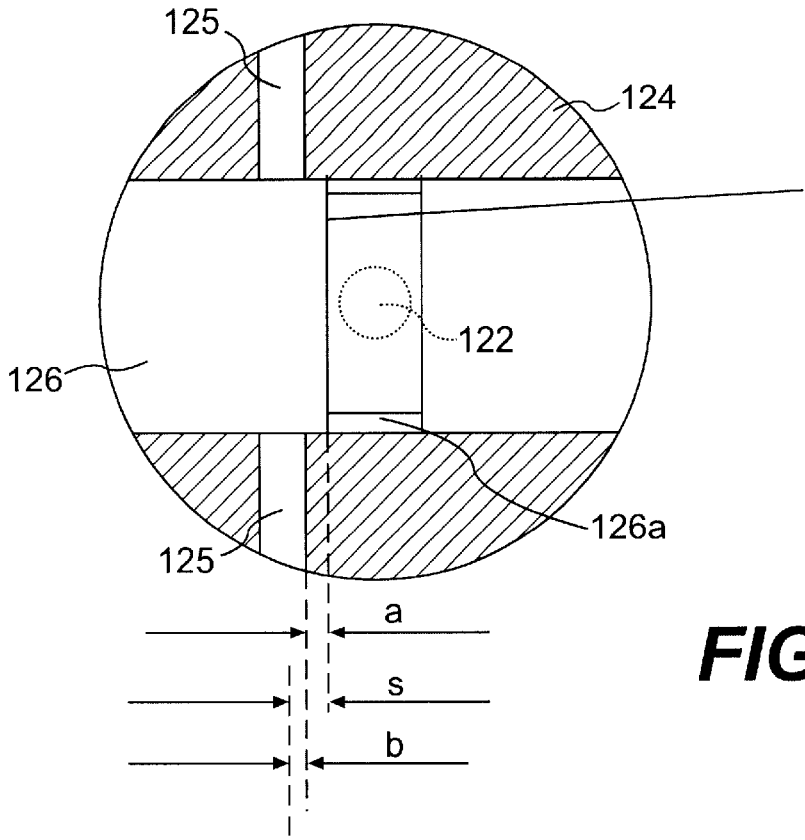
FIG. 4 shows an exploded view of the control valve of the present invention in a closed position.
Figure 5:
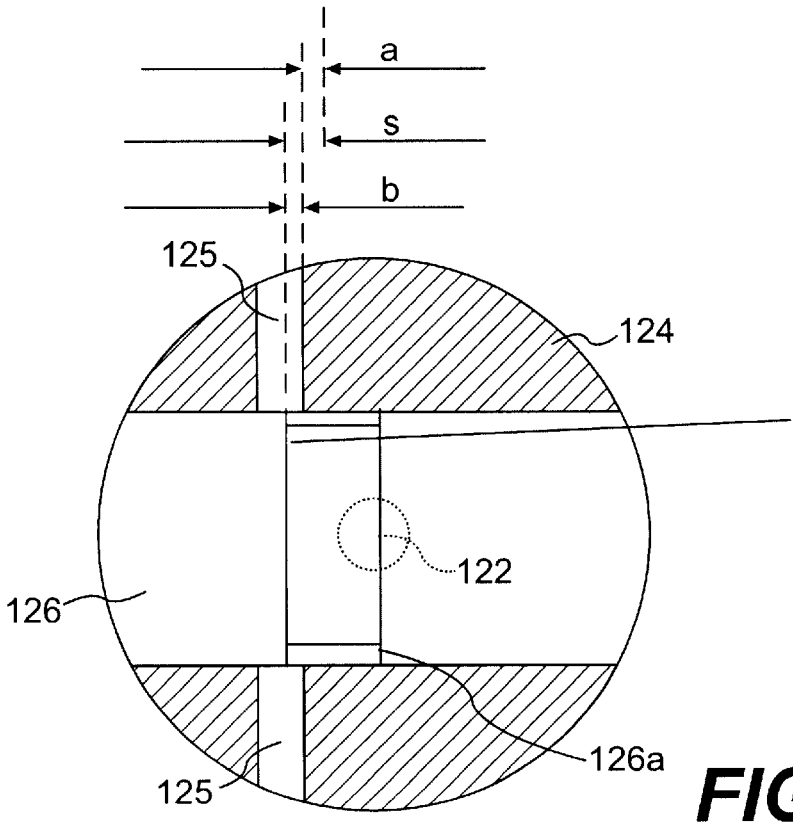
FIG. 5 shows an exploded view of the control valve of the present invention in a open position.

FIGS. 4 and 5 are exploded views of section A—A of FIG. 3. In FIG. 4, the groove 126*a* is offset from the cross bore 125 by a distance "a" when the spool 126 is in the closed or deactivated position. In FIG. 5, the groove 126*a* overlaps with the cross bore 125 by a distance "b" when the spool 126 is in the activated or open position. In the activated position, the groove 126 is also in fluid communication with the bore 122. As seen in FIGS. 4 and 5, the groove 126*a* moves a total distance "s" between the open and closed position of the spool 126.

Figure 6:
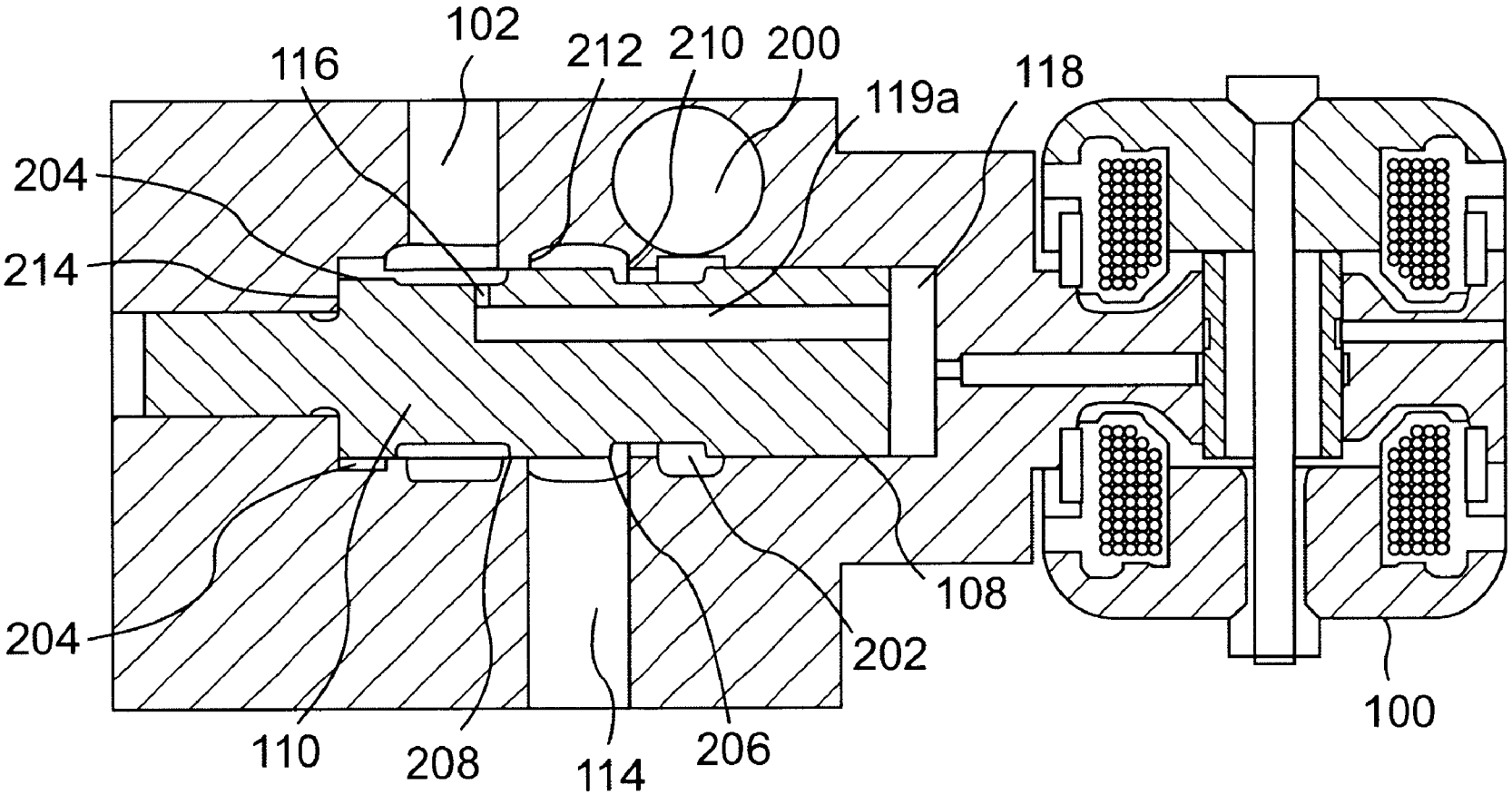
FIG. 6 shows an embodiment of the valve body with a spool in a first position used with the control valve of the present invention.

FIG. 6 shows an embodiment of the valve body used with the control valve of the present invention. In this embodiment, the valve body 104 includes a larger diameter central bore 108 which provides more flow area for the working fluid. The valve body further includes a cross bore 200 which leads to ambient. The cross bore 200 has a connection to groove 202. A front portion 204 of the spool 110 acts as a guide with a small passage to prevent piston effects. Control edges 206 and 208 of the spool 110 and control edges 210 and 212 of the valve body 104 are also provided. A ledge or stepped portion 214 is also provided in the valve body 108.

Figure 7:
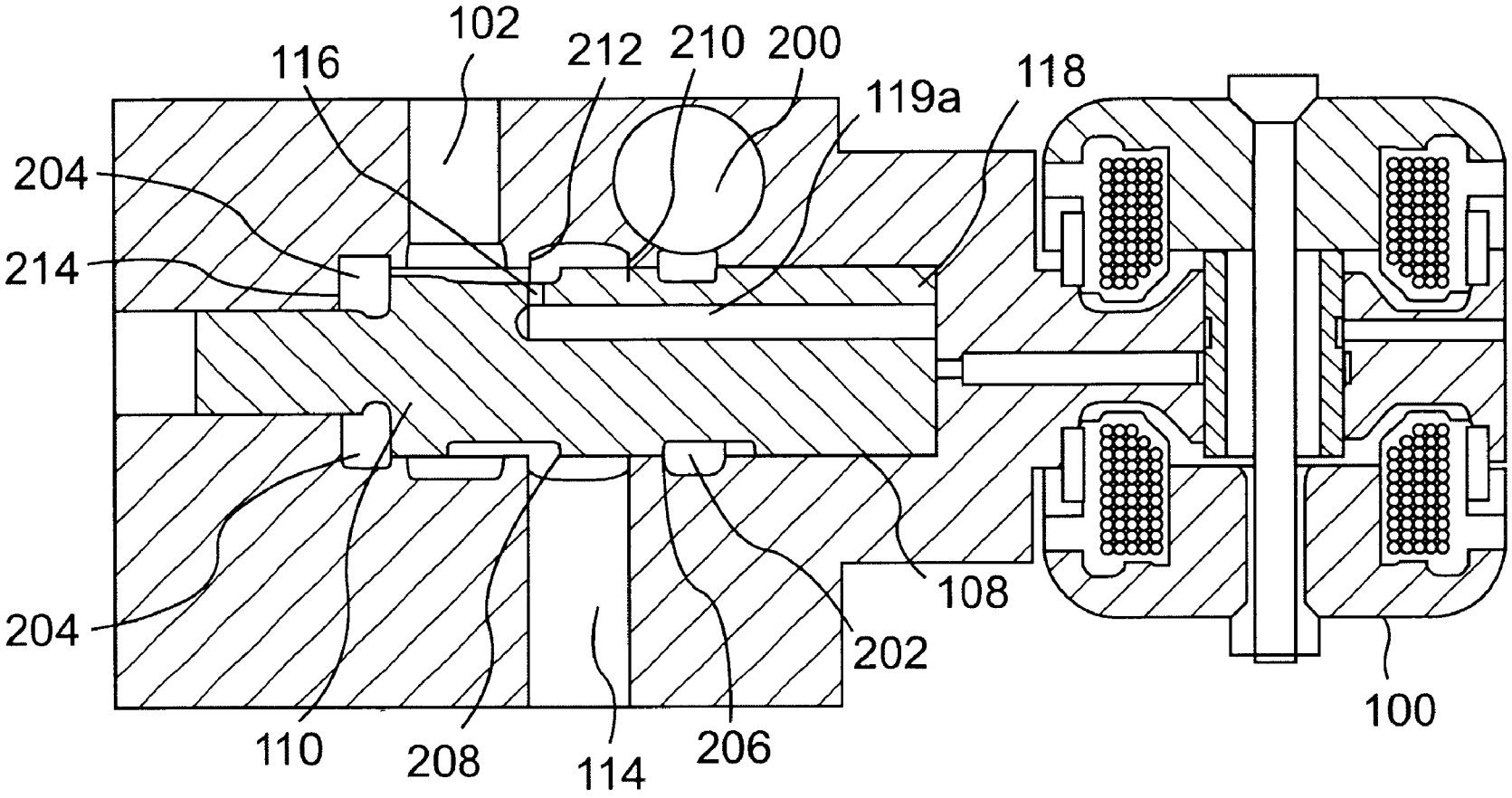
FIG. 7 shows the embodiment of the valve body with a spool in a second position used with the control valve of the present invention.

As shown in FIG. 7, the control edge 206 is aligned with an edge of the groove 202 and the control edge 212 is aligned with the working port 114. In this position (i.e., a second position), the return oil from the intensifier piston is in fluid communication with ambient via the bore 114, the spool control edge 206, the body control edge 210 to the groove 202 and cross bore 200. To activate, the injection control valve opens to ambient so that the pressure in the space 118 drops. The spool then moves to the right side providing a connection between the inlet 102 and the outlet 114 by the control edges 212 of the valve body and the control edge 208 of the spool. The advantage of this embodiment is a larger flow area for given dimensions and less oil consumption to control the spool. Additionally, the stop position (FIG. 6) is better defined with the stepped portion 214. The closed position can also be more easily adjusted using shims (not shown).

Operation of the Oil Activated Fuel Injector of the Present Invention

In operation, a driver (not shown) will first energize the coil. The energized coil will then shift the spool 126 to an open position. In the open position, the groove 126*a* will overlap with the bore 122 and the cross bore 125. This provides a fluid path for the working fluid to flow from the inlet port to ambient. In this position, the working fluid pressure within the pressure chamber 118 should be much lower than the rail inlet pressure. At this pressure stage, the spool 10 moves in the direction of arrow "A" thus sealing the venting space 107. This will allow the working fluid to flow between the inlet port 102 and the intensifier chamber via the working port 114.

Once the pressurized working fluid is allowed to flow into the working port 114 it begins to act on the piston and the plunger. That is, the pressurized working fluid will begin to push the piston and the plunger downwards thus compressing the intensifier spring. As the piston is pushed downward, fuel in the high pressure chamber will begin to be compressed via the end portion of the plunger. A quantity of compressed fuel will be forced through the bores into the heart chamber which surrounds the needle. As the pressure increases, the fuel pressure will rise above a needle check valve opening pressure until the needle spring is urged upwards. At this stage, the injection holes are open in the nozzle thus allowing a main fuel quantity to be injected into the combustion chamber of the engine.

To end the injection cycle, the driver will energize the closed coil. The magnetic force generated in the coil will then shift the spool 124 into the closed position which, in turn, will offset the groove 126*a* from the cross bore 125 (FIG. 4). At this stage, the pressure will begin to increase in the pressure chamber 118 and force the spool 110 in the direction of arrow "B". This will open the venting space 107 between the flat body area 106 and the leading edge 112*a* of the spool 110. Also, the inlet port 102 will no longer be in fluid communication with the bore 114 (and intensifier chamber). The working fluid within the intensifier chamber will then be vented to ambient and the needle spring will urge the needle downward towards the injection holes of the nozzle thereby closing the injection holes. Similarly, the intensifier spring will urge the plunger and the piston into the closed or first position adjacent to the valve. As the plunger moves upward, fuel will again begin to flow into the high pressure chamber of the intensifier body.

While the invention has been described in terms of preferred embodiments, those skilled in the art will recognize that the invention can be practiced with modification within the spirit and scope of the appended claims.

I claim:

1. A control valve for a fuel injector, comprising:

a valve body;

a spool positioned within a bore of the valve body and slidable between a first position and a second position;

a first bore in fluid communication with a rail inlet of the fuel injector;

a cross bore positioned within the valve body and offset from the first bore;

a groove located about the spool, the groove providing fluid communication between the cross bore and the first bore when the spool is in the first position and sealing fluid communication between the first bore and the cross bore when the spool is in the second position.

2. The control valve of claim 1, wherein the cross bore leads to ambient.

3. The control valve of claim 1, further comprising end caps having solenoids for moving the spool between the first position and the second position.

4. The control valve of claim 1, wherein the first bore is located within the valve body.

5. The control valve of claim 1, wherein the control valve controls the flow of working fluid to the fuel injector.

6. A valve body used with a control valve, the valve body including:

a control valve body;

a central bore provided in the control valve body and which provides flow area for working fluid;

a cross bore which leads to ambient and is in fluid communication with the central bore;

a spool disposed within the central bore, the spool having a front portion which acts as a guide with a small passage to prevent piston effects;

at least a first control edge associated with the spool;

at least a first control edge associated with the valve body; and a stepped portion provided in the valve body adapted to stop the spool in a first position, wherein return working fluid is in fluid communication with ambient via the at least one control edge of the spool and the valve body and the cross bore when the spool is in a second position.

7. The valve body of claim 6, wherein the at least first control edge of the spool is a first and a second control edge.

8. The valve body of claim 6, wherein the at least first control edge of the valve body is a first and a second control edge.

9. The valve body of claim 6, further comprising a groove in the control valve body which is in fluid communication with the cross bore, the return working fluid flowing through the groove in order to flow to ambient.

10. The valve body of claim 9, further comprising:

an inlet port positioned within the control valve body;

a working port providing fluid communication to an intensifier chamber of a fuel injector;

the spool being slidable between a first position and a second position and including a first leading edge and a second leading edge, the second leading edge aligning with the working port;

a space forming between the first leading edge and the control valve body when the spool in the second position;

a pressure chamber associated with the spool;

a control valve in communication with the pressure chamber, the control valve including:

a valve body;

a control spool positioned within a bore of the valve body and slidable between a first position and a second position;

a first bore in fluid communication with the pressure chamber;

a cross bore in fluid communication with ambient and positioned within the valve body and offset from the first bore; and a groove positioned about the control spool.

11. A fuel injector comprising:

a fuel injector body having a bore disposed therein;

an inlet port positioned within the fuel injector body;

a working port providing fluid communication to an intensifier chamber of the fuel injector;

a first spool positioned within the bore of the fuel injector body, the first spool being slidable between a first position and a second position and including a first leading edge and a second leading edge, the second leading edge aligning with the working port;

a space forming between the first leading edge and the fuel injector body when the first spool in the second position;

a pressure chamber associated with the first spool;

a control valve in communication with the pressure chamber, the control valve including:

a valve body;

a control spool positioned within a bore of the valve body and slidable between a first position and a second position;

a first bore in fluid communication with the pressure chamber;

a cross bore in fluid communication with ambient and positioned within the valve body and offset from the first bore; and a groove positioned about the control spool, wherein, in the first position of the control spool, the groove provides fluid communication between the cross bore and the first bore such that a pressure within the pressure chamber is substantially equal to a rail inlet pressure thereby permitting the first spool to move in the direction of the first position thereby sealing the space between the first leading edge and the fuel injector body and allowing working fluid to flow from the inlet port to the intensifier chamber, wherein, in the second position of the control spool, the groove moves out of alignment with the cross bore thus inhibiting fluid flow between the pressure chamber and ambient such that the pressure within the pressure chamber increases to a higher pressure than the rail inlet pressure thereby forcing the first spool in the direction of the second position to form the space between the first leading edge and the fuel injector body and allowing working fluid to vent to ambient from the intensifier chamber.

12. The fuel injector of claim 11, wherein the pressure chamber is formed in the bore of the fuel injector body between an end of the first spool and the valve body.

13. The fuel injector of claim 11, further comprising a servo piston partially disposed within a bore of the first spool, the servo piston having an axial bore in alignment and fluid communication with the first bore and the pressure chamber.

14. The fuel injector of claim 13, wherein the pressure chamber is formed within the bore of the of the first spool.

* * * * *

UNITED STATES PATENT AND TRADEMARK OFFICE

CERTIFICATE OF CORRECTION

PATENT NO. : 6,526,943 B2
DATED : March 4, 2003
INVENTOR(S) : Ulrich Augustin

It is certified that error appears in the above-identified patent and that said Letters Patent is hereby corrected as shown below:

The title page should be deleted and substitute therefore the attached title page.

Signed and Sealed this

First Day of July, 2003

JAMES E. ROGAN
*Director of the United States Patent and Trademark Office*

(12) United States Patent
Augustin

(10) Patent No.: US 6,526,943 B2
(45) Date of Patent: Mar. 4, 2003

(54) CONTROL VALVE FOR HYDRAULICALLY OIL ACTIVATED FUEL INJECTOR

(75) Inventor: Ulrich Augustin, Blythewood, SC (US)

(73) Assignee: Siemens Diesel Systems Technology, LLC, Blythewood, SC (US)

( * ) Notice: Subject to any disclaimer, the term of this patent is extended or adjusted under 35 U.S.C. 154(b) by 0 days.

(21) Appl. No.: 09/983,037

(22) Filed: Oct. 22, 2001

(65) Prior Publication Data

US 2002/0092501 A1 Jul. 18, 2002

Related U.S. Application Data

(60) Provisional application No. 60/261,813, filed on Jan. 17, 2001.

(51) Int. Cl.[7] ..... F02M 37/04
(52) U.S. Cl. ..... 123/446; 239/92
(58) Field of Search ..... 123/446; 239/92, 239/585.1

(56) References Cited

U.S. PATENT DOCUMENTS 4,182,492 A * 1/1980 Albert et al. ..... 239/92
5,479,901 A * 1/1996 Gibson et al. ..... 123/472
5,597,118 A * 1/1997 Carter, Jr. et al. ..... 239/92
5,669,355 A 9/1997 Gibson et al.
5,738,075 A 4/1998 Chen et al.
5,954,030 A 9/1999 Sturman et al.
6,065,450 A 5/2000 Chen et al.
6,082,332 A 7/2000 Hefler et al.
6,119,960 A * 9/2000 Graves ..... 239/92
6,129,072 A 10/2000 Graves

* cited by examiner

*Primary Examiner*—Thomas N. Moulis
(74) *Attorney, Agent, or Firm*—McGuireWoods LLP

(57) ABSTRACT

An oil activated fuel injector which includes a control valve having a groove which provides a fluid path between a bore and a cross bore of the valve body. The fluid path leads to ambient such that a pressure within a pressure chamber is less than that of the rail pressure. This equalized pressure allows the spool within the valve body to move to a first position thus forming a fluid path between an inlet port and the working port leading to the intensifier chamber. When the fluid path is blocked, via movement of the groove out of alignment with the cross bar, the pressure within the pressure chamber increases thereby forcing the spool to move towards a second position. In the second position, a space is formed between the spool and the body of the injector to provide venting of the working fluid from the intensifier chamber to ambient.

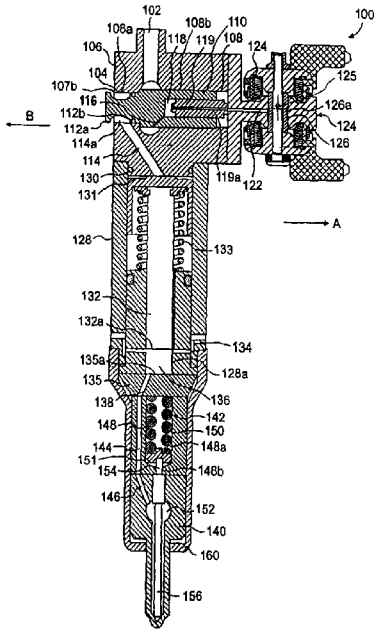

14 Claims, 6 Drawing Sheets